US007256363B1

(12) United States Patent
McConnell et al.

(10) Patent No.: US 7,256,363 B1
(45) Date of Patent: Aug. 14, 2007

(54) INTERMEDIATE SWITCH ACTUATOR ARRAY

(75) Inventors: John E. McConnell, Ann Arbor, MI (US); Bruce H. Pierik, Hazel Park, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/532,641

(22) Filed: Sep. 18, 2006

(51) Int. Cl.
*H01H 13/00* (2006.01)

(52) U.S. Cl. ..... 200/343; 200/296; 200/331

(58) Field of Classification Search ..... 200/296, 200/341–345, 330, 331, 329, 520; 341/22; 345/168, 169; 400/490–496
See application file for complete search history.

(56) References Cited

U.S. PATENT DOCUMENTS 6,384,355 B1 * 5/2002 Murphy et al. ..... 200/344
6,570,111 B2 * 5/2003 Nakagawa et al. ..... 200/343
6,580,044 B2 * 6/2003 Ogawa et al. ..... 200/552
6,828,516 B1 * 12/2004 Han ..... 200/5 A
6,880,989 B2 * 4/2005 Sotome ..... 396/502
6,906,060 B2 * 6/2005 Peschke et al. ..... 514/214.02
6,933,454 B2 * 8/2005 Ishibashi et al. ..... 200/341
6,987,235 B2 * 1/2006 Sambar et al. ..... 200/520
7,126,069 B2 * 10/2006 Mukougawa et al. ..... 200/293

* cited by examiner

*Primary Examiner*—Michael A. Friedhofer
(74) *Attorney, Agent, or Firm*—Earl LaFontaine

(57) ABSTRACT

A switch actuator assembly is provided comprising a circuit board housing including an upper housing and a lower housing forming a board compartment. A circuit board assembly, mounted within the board compartment, includes a switch element. A button assembly, positioned remotely from the upper housing, includes a cantilever button element. A plunger array assembly is included comprising a plunger array frame and a plunger element. The plunger element comprises a main plunger piston having a first plunger end configured to engage the cantilever button element only in a radial direction and a second plunger end configured to transfer force to the switch element. A plunger cantilever arm has a first cantilever end affixed to the plunger array frame and a second cantilever end affixed to the main plunger piston and is mounted in a mount position configured to minimize horizontal displacement of said second plunger end.

20 Claims, 3 Drawing Sheets

INTERMEDIATE SWITCH ACTUATOR ARRAY

TECHNICAL FIELD

The present invention relates generally to a switch actuator array and more particularly to a mechanical switch actuator array with extended distance between button and circuit board.

BACKGROUND OF THE INVENTION

The integration of electronic devices within larger systems such as automobiles commonly places considerable design considerations on the layout of such devices. Devices must not only be convenient, functional, and reliable, they must also be installed in areas with restricted space requirements. They often share this space with a variety of other devices, structures, and stiffeners. As such, it is often necessary to separate the button controls, which must remain in convenient reach of the operator, from the bulky circuit boards that represent the electronic device.

One approach to solving this spatial dilemma has been to operate with two circuit boards. The first is mounted directly behind the control buttons and the second is mounted remotely. A flexible ribbon connection or a wire harness connects the two boards. This methodology, however, is highly undesirable as it adds undesirable cost to manufacturing and assembly. In addition, the increase in components may lead to warranty considerations. A simple mechanical solution would reduce costs to both manufacturing and assembly. In addition, the reduction in components could decrease warranty costs.

One issue with the development of a simple mechanical connection arises through the use of cantilever button and post combinations. An elongated post, mounted to the button, can be utilized to transfer load from the button to the remote circuit board. Unfortunately, as the distance increases, so too does the horizontal displacement of the post near the circuit board. As the cantilever button rotates, it induces rotation into the post which in turn generates horizontal displacement at the far end. When it is intended for the post to contact a switch on the circuit board, this is problematic. Button surface activation commonly requires a direct perpendicular contact. Such contact may become unreliable with an increase in horizontal displacement.

An additional consideration arises when the circuit board must not only be mounted remotely, but on an angle relative to the button. This scenario often arises where the circuit board assembly must be angled to avoid or make way for additional structures within the automobile. In this scenario, linear movement of the button when directly translated to the switch would automatically be at an angle due to the circuit board orientation.

It would be highly desirable to have mechanical switch actuator assembly that would allow for remote placement of the circuit board relative to the button assembly. In addition, it would be highly desirable to have such a mechanical switch actuator assembly that could accommodate angled mounting of the circuit board relative to the button assembly.

SUMMARY OF THE INVENTION

In accordance with the objects of the present invention a switch actuator assembly is provided comprising a circuit board housing including an upper housing and a lower housing forming a board compartment. A circuit board assembly is mounted within the board compartment and includes a switch element mounted thereto. A button assembly is positioned remotely from the upper housing and includes a cantilever button element. A plunger array assembly is included comprising a plunger array frame and a plunger element. The plunger element comprises a main plunger piston having a first plunger end configured to engage the cantilever button element only in a radial direction and a second plunger end configured to transfer force from the button assembly to the switch element. A plunger cantilever arm has a first cantilever end affixed to the plunger array frame and a second cantilever end affixed to the main plunger piston and is mounted to the main plunger piston in a mount position configured to minimize horizontal displacement of the second plunger end.

Other objects and features of the present invention will become apparent when viewed in light of the detailed description and preferred embodiment when taken in conjunction with the attached drawings and claims.

DESCRIPTION OF PREFERRED EMBODIMENTS

Figure 1:
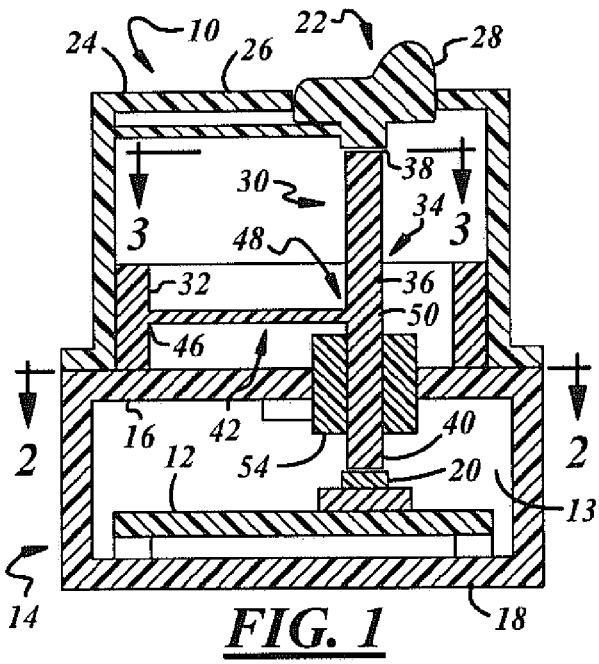
FIG. 1 is an illustration of a switch actuator assembly in accordance with the present invention.

Referring now to FIG. 1, which is an illustration of a switch actuator array 10 in accordance with the present invention. Although the present invention is contemplated for use in automotive interior control panels, it is understood that the developed technology disclosed herein may be applicable to a wide variety of button panel applications.

The switch actuator array 10 is comprised of a circuit board assembly 12 housed within the board compartment 13 of a circuit board housing 14. Although a wide variety of circuit board housings 14 are contemplated, a general description would include a lower housing and an upper housing 18. The upper and lower housings 16, 8 may be formed separately or independently. Although the circuit board assembly 12 is contemplated to include a wide variety of electrical components, it is contemplated that it will include at least one switch element 20. It is further contemplated that the switch actuator array 10 include a button assembly 22 positioned remotely and possibly at an angle to the circuit board assembly 12. Although a single button arrangement is described, it is contemplated that the button assembly 22 may be comprised of an array of buttons. In one embodiment, it is contemplated that the button assembly include a button array frame 24 having a button assembly upper surface 26 upon which a cantilever button element 28 is mounted. Although a variety of configurations are contemplated and illustrated, in one embodiment it is contemplated that the button array frame 24 is mounted to the upper housing 16.

As can be easily seen from the illustration, the distance between the switch element 20 and the cantilever button element 28 is remote enough to generate problems if a rigid post was to be mounted to the button element 28. As such, the present invention contemplated the use of a plunger array assembly 30. The plunger array assembly 30 (see FIGS. 3-6) preferably includes a plunger array frame 32 housing a plurality of plunger elements 34. Each plunger element 34 is preferably comprised of a main piston plunger 36 having a first plunge end 38 in configured to engage the cantilever button element 28 only in a radial direction and a second plunger end 40 configured to transfer force from the button assembly 22 to the switch element 20. It is contemplated that this transfer may be the result of either indirect or direct contact with the switch element 20. It is further contemplated that although the button array frame 24, the plunger array frame 32 and the circuit board housing 14 may be formed as independent entities, they may alternately be formed as a single unit.

In order to secure the main plunger piston 36 it is contemplated that each of the plunger elements 34 further include a plunger cantilever arm 42 having a first cantilever end 44 affixed to the plunger array frame 32 and a second cantilever end 46 fixed to the main plunger piston 36. The plunger cantilever arm 48 is preferably mounted to the main plunger piston 36 in a mount position 50 configured to minimize horizontal displacement of the second plunger end 40. In one embodiment, this is contemplated to represent approximately the mid-point between the first plunger end 38 and the second plunger end 40. In another embodiment it is contemplated to be a position in close proximity to the upper housing 16. By lowering the plunger cantilever arm 42 and removing the rigid connection to the cantilever button element 28, the present invention reduces horizontal displacement of the second plunger end 40 and thereby allows longer, more reliable connections.

Figure 2:
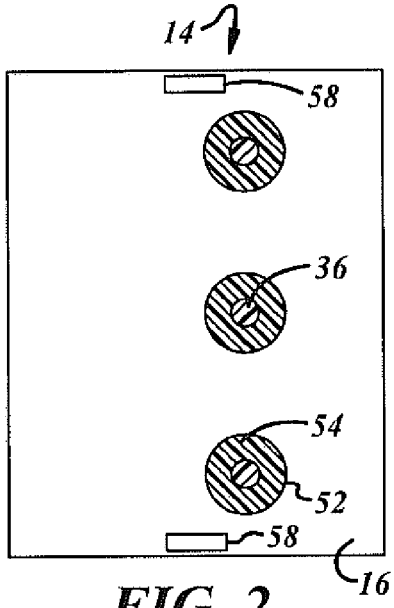
FIG. 2 is an illustration of a circuit board housing for use in the switch actuator assembly as illustrated in FIG. 1.
Figure 3:
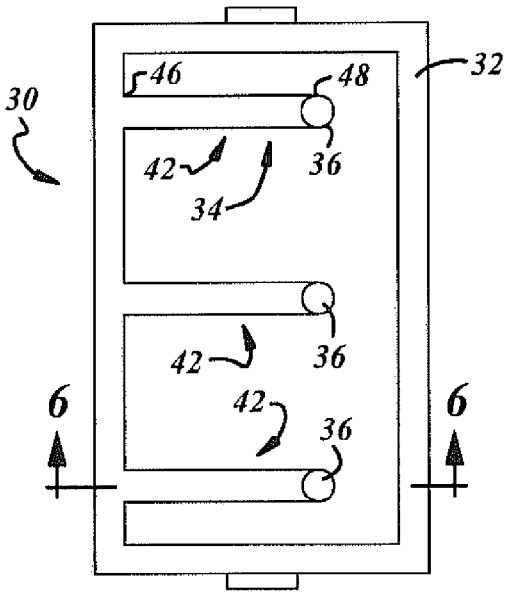
FIG. 3 is a detailed illustration of the plunger array for use in the switch actuator assembly illustrated in FIG. 1.
Figure 4:
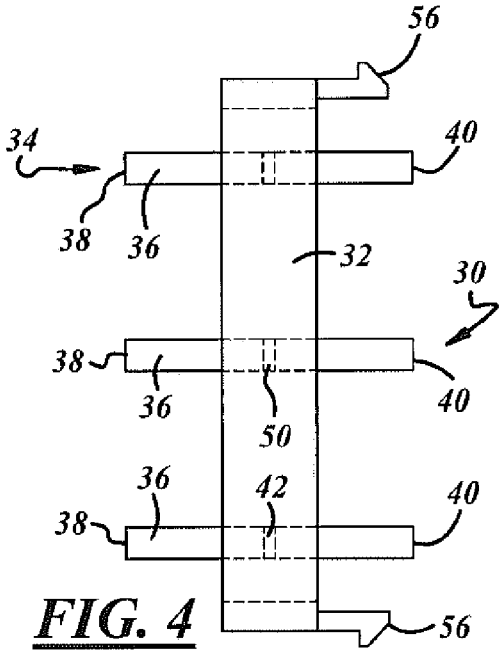
FIG. 4 is a side-view perspective of the plunger array illustrated in FIG. 3, the side-view taken along the long side.
Figure 5:
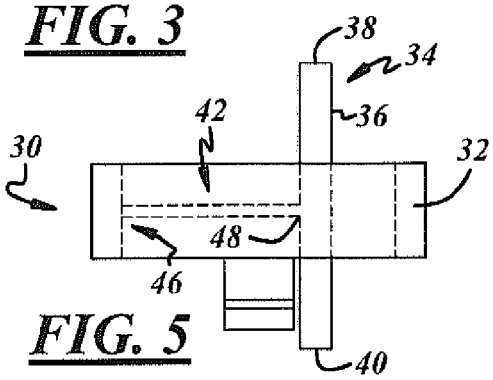
FIG. 5 is a side-view perspective of the plunger array illustrated in FIG. 3, the side-view taken along the short side.
Figure 6:
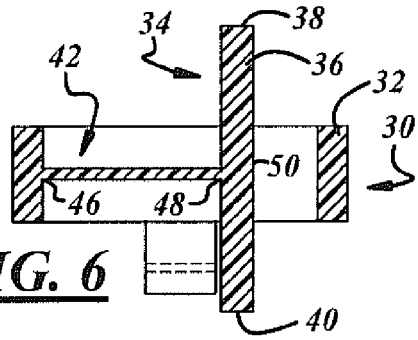
FIG. 6 is a cross-sectional illustration of the plunger array illustrated in FIG. 3, the cross-section taken along the lines 6-6 in the direction of the arrows.
Figure 7:
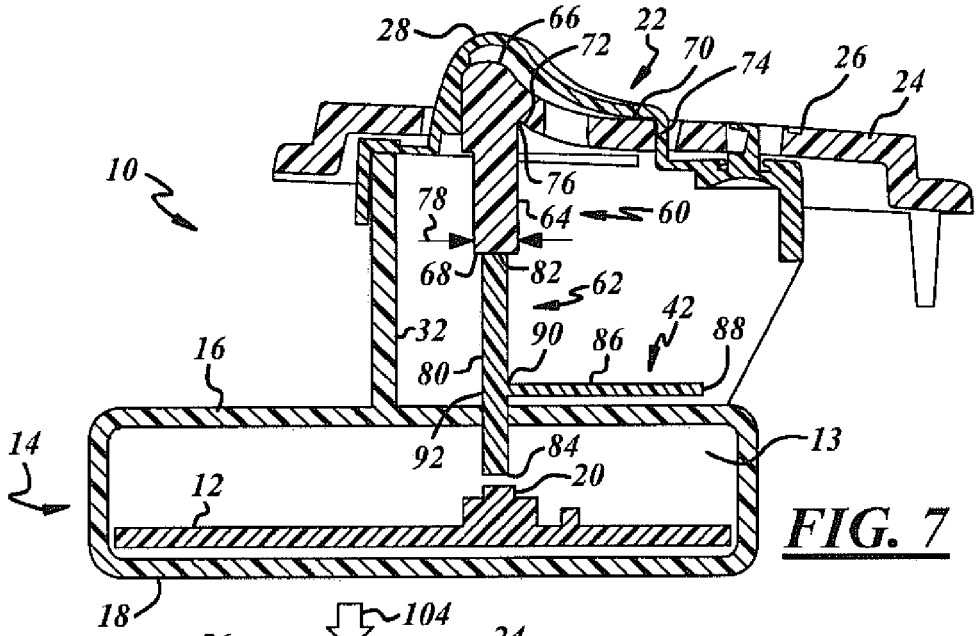
FIG. 7 is an illustration of a switch actuator assembly in accordance with the present invention, the illustration showing the use of upper and lower plunger assemblies.

It is further contemplated that the horizontal displacement may be further reduced by passing the main plunger piston 36 through form fitting entry gaps 52 formed in the upper housing 16. Guide block sleeves 54 may be positioned within each entry gap 52 to insure ease of travel and further reduce horizontal drift. As seen in FIG. 2, the combination of form fitting entry gaps 52 and appropriate guide block sleeves 54 provide extra stability to plunger element 34 movement. It is contemplated that the guide block sleeves 54 may be formed from a flexible material to allow for very slight horizontal drift. In addition, when used in combination with a plurality of snap fittings 56 formed the plunger array frame 32 and snap fitting slots 58 formed on the upper housing 16, the guide block sleeves 54 can properly orient the plunger array frame 32 for easy installation.

Where the distance between the cantilever button element 28 and the switch element 20 are even greater, it is contemplated that the single plunger element 34 positioned there between may be replaced by an upper plunger element 60 and a lower plunger element 62 (see FIG. 7). In this configuration, the upper plunger element 60 is comprised of an upper main plunger piston 64 having a fist upper plunger end 66 configured to engage the cantilever button element 28 and a second upper plunger end 68 positioned opposite. A upper cantilever arm 70 having a fist upper cantilever end 72 affixed to either the button array frame 24 or the plunger array frame 32 (it should be understood that these frames can be identical). A second upper cantilever end 74 is attached to the upper main plunger piston 64. The second upper cantilever end 74 is preferably attached in an upper mount position 76 wherein horizontal displacement of the second upper plunger end 68 can be minimized. It is contemplated that alternately or additionally the upper plunger width 78 may be increased to minimize the effect of any horizontal displacement.

The lower plunger element 62 is positioned below the upper plunger element 60 and between the upper plunger element 60 and the switch element 20. The lower plunger element 62 is comprised of a lower main plunger piston 80 having a first lower plunger end 82 configured to engage the second upper plunger end 68 only in a radial direction. The second lower plunger end 84 configured to transfer force from the button assembly 22 to the switch element 20. The lower plunger element 62 is mounted via a lower plunger cantilever arm 86 mounted thereto. The lower plunger cantilever arm 86 includes a first lower cantilever end 88 affixed to the plunger array frame 32 or other surrounding structure and a second lower cantilever end 90 mounted to the lower main plunger piston 80 in a lower mount position 92. The lower mount position 92 is preferably between the fist lower plunger end 82 and the second lower plunger end 84 and near a midpoint. When using an upper plunger element 60 and lower plunger element 62 in combination, both the plunger length and rotational axis are reduced and therefore the horizontal displacement of the second lower plunger end 84 is significantly reduced.

Often, it is not simply distance between the button assembly 22 and the switch element 20 which causes mechanical issues. Often the circuit boar assembly 12 or the circuit board housing 14 may need to be positioned at an angle 94 relative to the main plunger piston 36 and the general implementation direction of the cantilever button element 28. This can cause activation issues if direct contact between the main plunger piston 36 and the switch 20 is contemplated. In one application the angle 94 was required to be 17 degrees. Therefore, as shown in FIGS. 7-13 the present invention contemplates the use of a cantilever switch actuator positioned on the upper housing 16. The cantilever switch actuator 96 includes a fixed actuator end 98, an actuator body 100, and a free actuator end 102.

Figure 8:
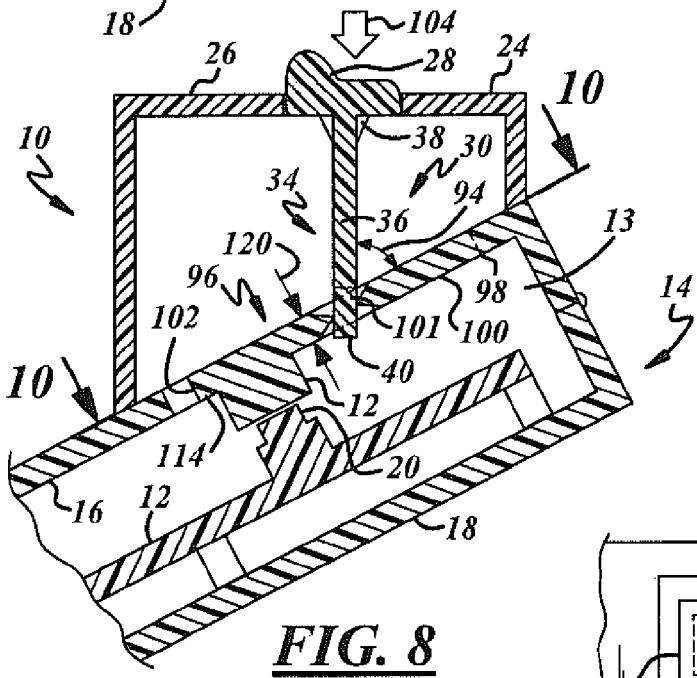
FIG. 8 is an illustration of a switch actuator assembly in accordance with the present invention, the assembly including the use of a cantilever switch actuator.
Figure 9:
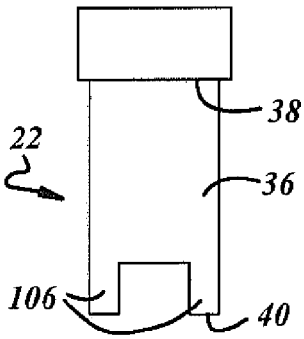
FIG. 9 is a detailed illustration of a button assembly for use in the switch actuator assembly illustrated in FIG. 8.
Figure 10:
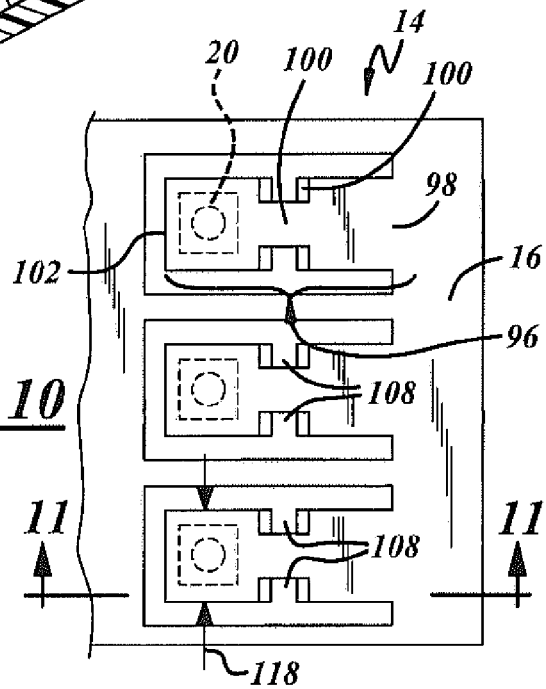
FIG. 10 is a top-view detail illustration of the upper housing portion of the switch actuator assembly illustrated in FIG. 8.
Figure 11:
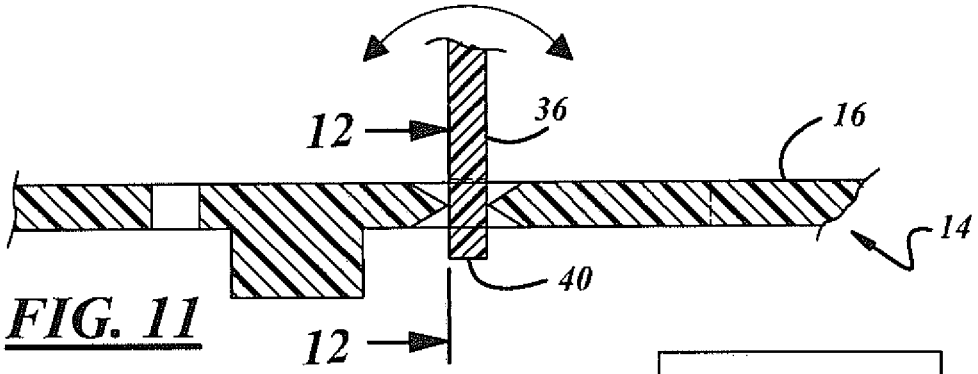
FIG. 11 is a cross-sectional illustration of the upper housing portion illustrated in FIG. 10, the cross-section taken along the lines 11-11 in the direction of the arrows.
Figure 12:
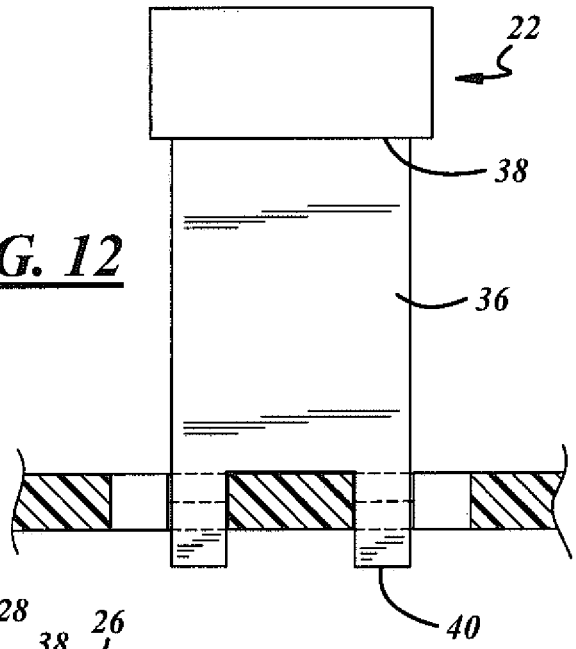
FIG. 12 is a detailed illustration of the interaction between the button assembly and the cantilever switch actuator utilized in the switch actuator assembly shown in FIG. 8.
Figure 13:
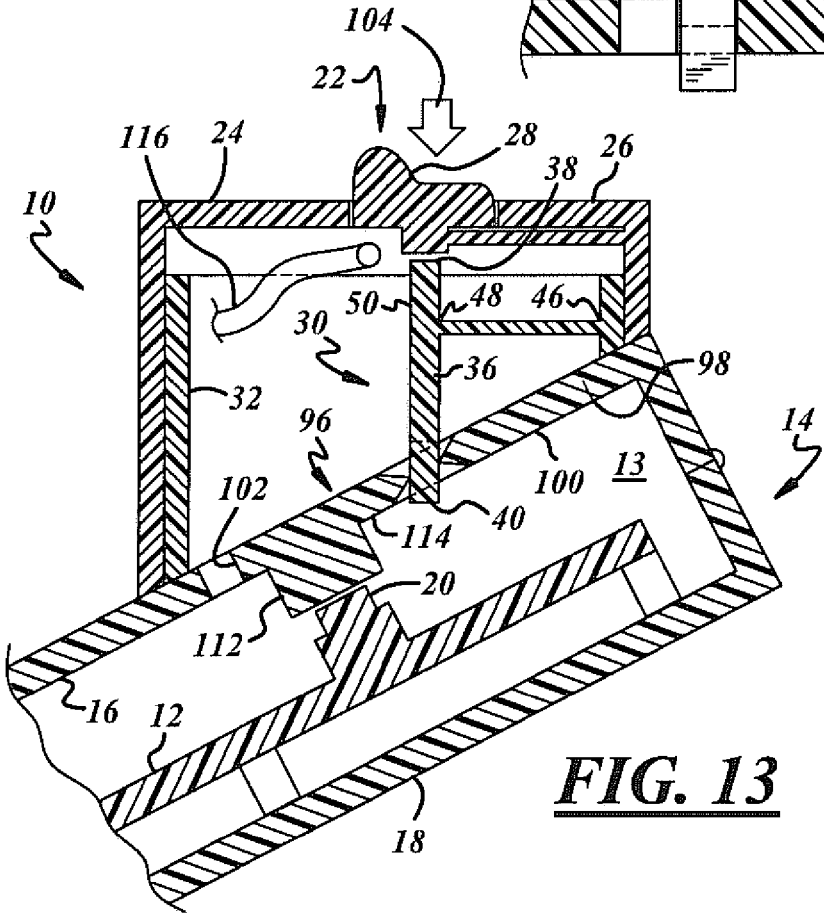
FIG. 13 is an illustration of a switch actuator assembly in accordance with the present invention, the switch actuator assembly including both a plunger cantilever arm and a cantilever switch actuator.

The main plunger piston 36 connects to the cantilever switch actuator 96 along the actuator body 100 at an engagement position 101. Button activation force 104 applied to the cantilever button element 28 is transferred via the main plunger piston 36 to the cantilever switch actuator 96. The cantilever switch actuator 96 then moves such that the free actuator end 102 actuates the switch element 20. This configuration accommodates both a rigid connection between the main plunger piston 36 and the cantilever button element 28 as shown in FIG. 8 as well as the cantilever plunger elements already described as shown in FIG. 13. It is contemplated that the cantilever switch actuator 96 may be formed integrally with the upper housing 16 or may be separately attached.

It is contemplated that the second plunger end 40 in this configuration may include a pair of alignment tabs 106 formed thereon and configured to engage a pair of corresponding alignment slots 108 formed on the actuator body 100. This helps proper assembly of the plunger element 34 into the engagement position 101. It is also contemplated that the engagement position 101 include a chamfer region 110 formed to allow the second plunger end to engage the actuator body 100 with relative rotational freedom. This allows the main plunger piston 36 to achieve vertical motion while allowing the actuator body 100 to experience relative rotational motion on the way to contacting the switch element 20. A switch actuator pad 112 positioned on the cantilever switch actuator lower surface 114 reduces the amount of travel required for the free actuator end 102 to activate the switch element 28. A light pipe 116 may be positioned immediately behind the cantilever button element 28 due toe the extended distance to the circuit board housing 14.

It is contemplated that the present invention can tailor the button activation force 104 using a variety of methodologies. In one approach, the actuator width 118 and the actuator thickness 120 may be configured to tailor the button activation force 104 to desired levels. Thinning the actuator thickness 120 or decreasing the actuator width 118 will reduce button activation force. In addition, placement of the engagement position 101 may be also or in addition be utilized to tailor button activation force. The present invention provides a flexible approach allowing a wide variety of button/circuit board arrangements not accommodated by existing technology without undue cost.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A switch actuator assembly comprising:

a circuit board housing including an upper housing and a lower housing forming a board compartment;

a circuit board assembly mounted within said board compartment, said circuit board assembly including a switch element mounted thereto;

a button assembly positioned remotely from said upper housing, said button assembly including a cantilever button element;

a plunger array assembly comprising:

a plunger array frame;

a plunger element positioned within said plunger array frame, said plunger element comprising a main plunger piston having a first plunger end configured to engage said cantilever button element only in a radial direction and a second plunger end configured to transfer force from said button assembly to said switch element; and a plunger cantilever arm having a first cantilever end affixed to said plunger array frame and a second cantilever end affixed to said main plunger piston between said first plunger end and said second plunger end, said plunger cantilever arm mounted to said main plunger piston in a mount position configured to minimize horizontal displacement of said second plunger end.

2. A switch actuator assembly as described in claim 1, further comprising:

an entry gap formed in said upper housing;

a guide block sleeve positioned within said entry gap, said second plunger end protruding through said guide block sleeve to engage said switch element.

3. A switch actuator assembly as described in claim 1, wherein:

said plunger array frame affixed to said upper housing by way of a plurality of snap-fittings.

4. A switch actuator assembly as described in claim 1, further comprising:

a button array frame mounted to said plunger array frame opposite said upper housing, said button cantilever button element mounted to said button array frame.

5. A switch actuator assembly as described in claim 1, wherein said plunger cantilever arm is positioned in close proximity to said upper housing.

6. A switch actuator assembly as described in claim 1, wherein said second cantilever end is mounted in approximately a midpoint between said first plunger end and said second plunger end.

7. A switch actuator assembly as described in claim 1, wherein a button array frame is mounted to said upper housing over said plunger array frame.

8. A switch actuator assembly as described in claim 1, wherein:

said button assembly comprises a plurality of cantilever button elements;

said plunger array assembly comprises a plurality of plunger elements, each of said plurality of plunger elements corresponding to one of said cantilever button elements.

9. A switch actuator assembly as described in claim 1, further comprising:

a cantilever switch actuator positioned on said upper housing, said cantilever switch actuator comprising a fixed actuator end, an actuator body, and a free actuator end;

said second plunger end engaging said switch actuator body, said plunger element configured to move said cantilever switch actuator in response to force on said button element such that said free actuator end activates said switch element.

10. A switch actuator assembly comprising:

a circuit board housing including an upper housing and a lower housing forming a board compartment;

a circuit board assembly mounted within said board compartment, said circuit board assembly including a switch element mounted thereto;

a button assembly positioned remotely from said upper housing, said button assembly including a cantilever button element;

a plunger array assembly comprising:

a plunger array frame;

an upper plunger element positioned within said plunger array frame, said upper plunger element comprising a upper main plunger piston having a first upper plunger end configured to engage said cantilever button element only in a radial direction and a second upper plunger end; and an upper plunger cantilever arm having a first upper cantilever end affixed to said plunger array frame and a second upper cantilever end affixed to said upper main plunger piston between said first upper plunger end and said second upper plunger end, said plunger cantilever arm mounted to said upper main plunger piston in an upper mount position configured to minimize horizontal displacement of said second upper plunger end; and a lower plunger element positioned within said plunger array frame, said lower plunger element comprising a lower main plunger piston having a first lower plunger end configured to engage said second upper plunger end only in a radial direction and a second lower plunger end configured to transfer force from said button assembly to said switch element;

a lower plunger cantilever arm having a first lower cantilever end affixed to said plunger array frame and a second lower cantilever end affixed to said lower main plunger piston between said first lower plunger end and said second lower plunger end, said plunger cantilever arm mounted to said lower main plunger piston in a lower mount position configured to minimize horizontal displacement of said second lower plunger end.

11. A switch actuator assembly comprising:

a button array frame including a button assembly upper surface;

a button assembly including a cantilever button element;

a circuit board housing including an upper housing and a lower housing forming a board compartment, said upper housing positioned remotely and at an angle from said button assembly upper surface;

a cantilever switch actuator positioned on said upper housing, said cantilever switch actuator comprising a fixed actuator end, an actuator body, and a free actuator end;

a circuit board assembly mounted within said board compartment, said circuit board assembly including a switch element mounted thereto;

a plunger element comprising a main plunger piston having a first plunger end engaging said cantilever button element and a second plunger end, said second plunger end engaging said switch actuator body, said plunger element configured to move said cantilever switch actuator in response to force on said button element such that said free actuator end activates said switch element.

12. A switch actuator assembly as described in claim 11, further comprising:

a pair of alignment tabs formed on said second plunger end; and a pair of corresponding alignment notches formed in actuator body, said alignment tabs configured to engage said pair of alignment tabs.

13. A switch actuator assembly as described in claim 11, further comprising:

a chamfer region formed in said actuator body, said second plunger end engaging said actuator body in said chamfer region, said chamfer region allowing said second plunger end to engage said actuator body with rotational freedom.

14. A switch actuator assembly as described in claim 11, further comprising:

a switch actuator pad position on a cantilever switch actuator lower surface, said switch actuator pad configured to engage said switch element.

15. A switch actuator assembly as described in claim 11, wherein said cantilever switch actuator is formed integrally with said upper housing.

16. A switch actuator assembly as described in claim 11, further comprising:

a plunger cantilever arm having a first cantilever end affixed to a plunger array frame and a second cantilever end affixed to said main plunger piston between said first plunger end and said second plunger end, said plunger cantilever arm mounted to said main plunger piston in a mount position configured to minimize horizontal displacement of said second plunger end.

17. A switch actuator assembly as described in claim 11, wherein said main plunger piston engages said upper housing at an angle of more than 15 degrees off perpendicular.

18. A switch actuator assembly as described in claim 11, wherein:

said cantilever switch actuator comprises an actuator width and an actuator thickness, said actuator width and said actuator thickness configured to tailor a button activation force.

19. A switch actuator assembly as described in claim 11, wherein said second plunger end engages said actuator body in an engagement position, said engagement position configured to tailor a button activation force.

20. A switch actuator assembly as described in claim 11, further comprising:

a light pipe positioned behind said cantilever button element.

* * * * *